US009009932B2

(12) United States Patent
Thorbole et al.

(10) Patent No.: US 9,009,932 B2
(45) Date of Patent: Apr. 21, 2015

(54) BUCKLE FOR PREVENTING INERTIAL DE-BUCKLING

(75) Inventors: Chandrashekhar Thorbole, Springdale, AR (US); David Renfroe, Fayetteville, AR (US)

(73) Assignee: The Engineering Institute, LLC, Farmington, AZ (US)

( * ) Notice: Subject to any disclaimer, the term of this patent is extended or adjusted under 35 U.S.C. 154(b) by 156 days.

(21) Appl. No.: 13/471,812

(22) Filed: May 15, 2012

(65) Prior Publication Data

US 2013/0125355 A1 May 23, 2013

Related U.S. Application Data

(60) Provisional application No. 61/486,350, filed on May 16, 2011.

(51) Int. Cl.
*A44B 11/26* (2006.01)
*A44B 11/25* (2006.01)

(52) U.S. Cl.
CPC ..... *A44B 11/2561* (2013.01); *A44B 11/2511* (2013.01)

(58) Field of Classification Search
USPC ..... 24/650, 638, 647; 267/140.4, 141, 267/DIG. 3, 182
See application file for complete search history.

(56) References Cited

U.S. PATENT DOCUMENTS

| | | | | | |
|---|---|---|---|---|---|
| 3,594,872 | A * | 7/1971 | Kulwin et al. | ..... | 24/650 |
| 3,639,951 | A * | 2/1972 | Inoue et al. | ..... | 24/650 |
| 4,368,563 | A * | 1/1983 | Lentz | ..... | 24/637 |
| 4,955,115 | A * | 9/1990 | Tanaka | ..... | 24/641 |
| 5,010,630 | A * | 4/1991 | Mickelson | ..... | 24/647 |
| 5,115,543 | A * | 5/1992 | Fohl | ..... | 24/633 |
| 6,539,595 | B1 * | 4/2003 | Benedict | ..... | 24/633 |
| 7,370,393 | B2 * | 5/2008 | Hlavaty et al. | ..... | 24/633 |
| 8,108,976 | B2 * | 2/2012 | Thorbole et al. | ..... | 24/650 |
| 2008/0313871 | A1 | 12/2008 | Thorbole et al. | | |

* cited by examiner

*Primary Examiner* — Jack W Lavinder
(74) *Attorney, Agent, or Firm* — Cowan, Liebowitz & Latman, P.C.; Mark Montague

(57) ABSTRACT

A seat belt buckle assembly for resisting unintentional opening during rapid acceleration or deceleration. The seat belt buckle assembly includes a female buckle, a male tongue plate, a pawl assembly, a spring and a load rate sensitive foam member. The female buckle is a casing with an open end that is adapted to receive the substantially planar male tongue plate provided with a slot. The pawl assembly housed within the casing includes a pawl that fits within the slot. The spring disposed between casing and pawl assembly urges the pawl into slot and elastically deforms when subjected to force. The load rate sensitive foam member interposed between spring and pawl assembly transmits load applied on pawl to spring for facilitating compression of spring and therefore unlatching of the buckle in case of gradual loading, but inhibiting involuntary compression of spring by absorbing most of the impulsive loading.

5 Claims, 3 Drawing Sheets

BUCKLE FOR PREVENTING INERTIAL DE-BUCKLING

REFERENCE TO RELATED APPLICATION

This application claims priority to U.S. Provisional Patent Application No. 61/486,350, filed May 16, 2011, the disclosure of which is incorporated herein by reference.

FIELD OF THE DISCLOSURE

The present disclosure generally relates to a buckle.

Particularly, the disclosure relates to a buckle for a seat belt that resists unlatching when subjected to rapid acceleration or deceleration.

BACKGROUND OF THE DISCLOSURE

A seat belt, sometimes called a safety belt, is a safety harness designed to secure an occupant of a vehicle against harmful movement that may result from a collision or a sudden stop. The seat belts are designed to absorb energy by getting stretched during any sudden deceleration, so that there is less speed differential between passenger's body and the interior of the vehicle. Further, the seat belts are capable of spreading the loading of impact on the passenger's body. In most jurisdictions, regulations require that motor vehicles be equipped with seat belts fitted directly or indirectly to the vehicle body at anchorage points in order to secure at least the driver to the driver's seat in the event of accidents. Conventional webbed seat belts include a buckle mechanism wherein one free end of the seat belt has a tongue plate affixed thereto and the opposing free end of the seat belt has a buckle affixed thereto. When the tongue plate is inserted into the main body of the buckle, a latch member housed within the buckle, which is conventionally a spring-loaded pawl, lockingly engages a hole in the tongue plate. The latched state (i.e., locked state) is maintained by a locking member, usually a spring, until the pawl is released from locking engagement with the hole in the tongue plate by manually depressing a release button housed on the buckle. The locked condition is maintained because the latch (pawl) is constantly urged (pushed outwardly) by a spring member to lockingly engage the hole in the tongue plate.

In order to cancel the latching of the tongue plate and the buckle, a release button provided on the buckle is pressed. More particularly, the latch engagement is cancelled and the tongue plate is disengaged from the main body of the buckle when the locked state of the latch is cancelled by the aforesaid pressing operation of the release button. However, in order to prevent de-buckling of the buckle in case of a high G event such as a sudden deceleration occurring due to collision, the tongue plate should be reliably held in the locked state even if an impact (i.e., a high G event) is acting on the buckle. In an automobile, the release button, which is operable for releasing the buckle assembly from the locked state, is structured so as to be able to be pressed by a relatively small force sufficient to overcome the urging force of the spring member and enable disengagement of the tongue plate from the buckle.

Also, it is important that automobile seat belt buckles do not open unintentionally in the event that a "high G" event such as a crash occurs. When the buckle to which the tongue plate is locked is instantaneously pulled, a condition referred to as "reverse G" occurs in the buckle. In a conventional buckle, even when the release button is not pressed, there is a risk that the tongue plate will disengage from the buckle by the latch being unintentionally cancelled such as may occur when the buckle main body is forcibly and rapidly accelerated or decelerated. When such reverse G conditions occur, an inertial force corresponding to the total mass of the release button and locking mechanism housed within the case of the buckle main body, acts on the release button, locking mechanism and the like in a direction such that the lock state is released. As a result, the lock state may be forcibly cancelled and the tongue plate may release from the buckle main body. Such an incident is detrimental to the safety of the occupant wearing the seat belt.

In order to prevent the tongue plate from getting released from the main buckle body in the conventional seat belt buckle, the spring force of the spring, which constantly urges the latch to a locked position, may be increased. In order to increase the spring force of the spring, larger sized spring may be used. However, as the spring becomes larger in size, the release force that must be applied to the release button for releasing the locking state of the latch against spring force of the spring is also increased. However, such an increase in release force that must be applied to the release button for releasing the locking state of the latch against spring force of the spring is also undesirable, such an increase in release force may hinder intentional unlatching of the buckle by elderly occupants in the vehicle.

A few prior art documents disclose a seat belt buckles that address the problem of unintentional release of seat belt buckles during a high G event such as collisions.

For example, US Published Patent Application numbered US2008313871 (A1) discloses a buckle for a seat belt that resists unintentional unlatching when subjected to rapid acceleration or deceleration. The buckle assembly includes a female buckle and a removable male tongue plate. The female buckle includes a spring-loaded pawl that lockingly engages a slot in the removable tongue plate. The spring urges the pawl into locking engagement with the slot in the tongue plate. The present disclosure discloses a pawl-loading spring made from a material that resists elastic deformation when the buckle is subjected to a force perturbation such as the sudden acceleration or deceleration of the buckle that occurs during a crash. The spring material exhibits resistance to deformation when loaded at a high loading rate. Furthermore, the female buckle comprises a damping device disposed between the pawl and the casing of the buckle. The damping device, which may be a compressible hydraulic or pneumatic member, is operable for resisting elastic deformation of the spring, and translational motion of the pawl, when the pawl is subjected to a change in force having duration of between 1-5 milliseconds. The damping device only permits substantial translational motion of the pawl (i.e., motion sufficient to disengage the pawl from the slot) when the pawl is subjected to a change in force having a duration greater than 5 milliseconds such as occurs during intentional manual depression of the pawl to release the seat belt buckle. However, the damping device involves large number of parts and adds to complexity of the buckle structure and it's operation. Further, the buckle as disclosed in the '871 US Published Application is ineffective and requires a large number of components, thereby making the buckle susceptible to frequent failures and thereby reducing it's reliability. Furthermore, buckle utilizes a complex mechanism for effectively resisting unintentional unlatching when subjected to rapid acceleration or deceleration.

Accordingly, there is a need for a buckle for a seat belt that resists unintentional unlatching when subjected to rapid acceleration or deceleration. Further, there is a need for a buckle that utilizes simpler mechanism and less number of components and accordingly is more reliable in ensuring safety of the driver wearing the seat belt.

OBJECTS AND SUMMARY OF THE INVENTION

Some of the objects of the present disclosure, which at least one embodiment herein satisfy, are as follows:

It is an object of the present disclosure to provide a buckle for a seat belt that resists unintentional unlatching when subjected to rapid acceleration or deceleration.

It is another object of the present disclosure to provide a buckle for a seat belt that is unresponsive to a force impulse having duration of 1-5 milliseconds or less.

It is yet another object of the present disclosure to provide a buckle for a seat belt that is responsive to a uniform force applied to overcome the force of the spring over a longer period of time such as 1 second.

It is still another object of the present disclosure to provide a buckle for a seat belt that is reliable in ensuring safety of the driver wearing the seat belt.

One more object of the present disclosure to provide a buckle for a seat belt that is easy to manufacture.

It is still another object of the present disclosure to provide a buckle for a seat belt that is having a simple structure.

It is yet another object of the present disclosure to provide a buckle for a seat belt that requires lesser number of components.

It is another object of the present disclosure to provide a buckle for a seat belt that is simple to assemble.

One more object of the present disclosure is to provide a buckle for a seat belt that is inexpensive.

SUMMARY OF THE INVENTION

A seat belt buckle assembly operable for resisting unintentional opening when subjected to rapid acceleration or deceleration is disclosed. The seat belt buckle assembly includes a female buckle, a male tongue plate, a pawl assembly, a spring and a load rate sensitive foam member. The female buckle is having a casing with an open end. The male tongue plate is substantially planar and is provided with a slot configured thereon, wherein a portion of the tongue plate having the slot is adapted to be received by the open end of the casing and the male tongue plate is adapted to slide inside the female buckle. The pawl assembly is housed within the casing and includes a pawl dimensioned to fit within the slot in the tongue plate. The spring is disposed between the casing and the pawl assembly. Further the spring is operable for urging the pawl of the pawl assembly into the slot, the spring is elastically deformable when subjected to force applied on the pawl. The load rate sensitive foam member is interposed between the spring and the pawl assembly, wherein the load rate sensitive foam member transmits load applied on the pawl to the spring for facilitating compression of the spring and therefore unlatching of the buckle in case of gradual loading, but inhibiting involuntary compression of the spring by absorbing most of the impulsive loading acting on the pawl.

Typically, the load rate sensitive foam member is made from polyethylene scaffold.

Generally, load rate sensitive foam member is impregnated with carbon nano-particles.

Further, the load rate sensitive foam member is configured to fit in the space between the spring and the pawl assembly.

Typically, the spring is made from a material that exhibits elastic properties.

Various other objects, advantages and features of the present invention will become readily apparent to those of ordinary skill in the art, and the novel features will be particularly pointed out in the appended claims.

BRIEF DESCRIPTION OF THE DRAWINGS

The invention will now be described with the help of accompanying drawings, in which:

FIG. 3(*b*) illustrates a front view for the tongue and buckle arrangement of FIG. 3(*a*);

FIG. 3(*c*) illustrates a side view for the tongue and buckle arrangement of FIG. 3(*a*); and FIG. 3(*d*) illustrates an isometric view for the tongue and buckle arrangement of FIG. 3(*a*).

DETAILED DESCRIPTION OF THE PRESENT INVENTION

The drawings and the description thereto are merely illustrative of a buckle for preventing inertial de-buckling and only exemplify the disclosure and in no way limit the scope thereof.

The disclosure proposes a tongue and buckle arrangement for a seat belt or seat belt buckle assembly, wherein the tongue and buckle arrangement resists unintentional unlatching when subjected to rapid acceleration or deceleration. Further, the tongue and buckle arrangement utilizes simpler mechanism and less number of components and accordingly is more reliable in ensuring safety of the driver wearing the seat belt.

Figure 1:
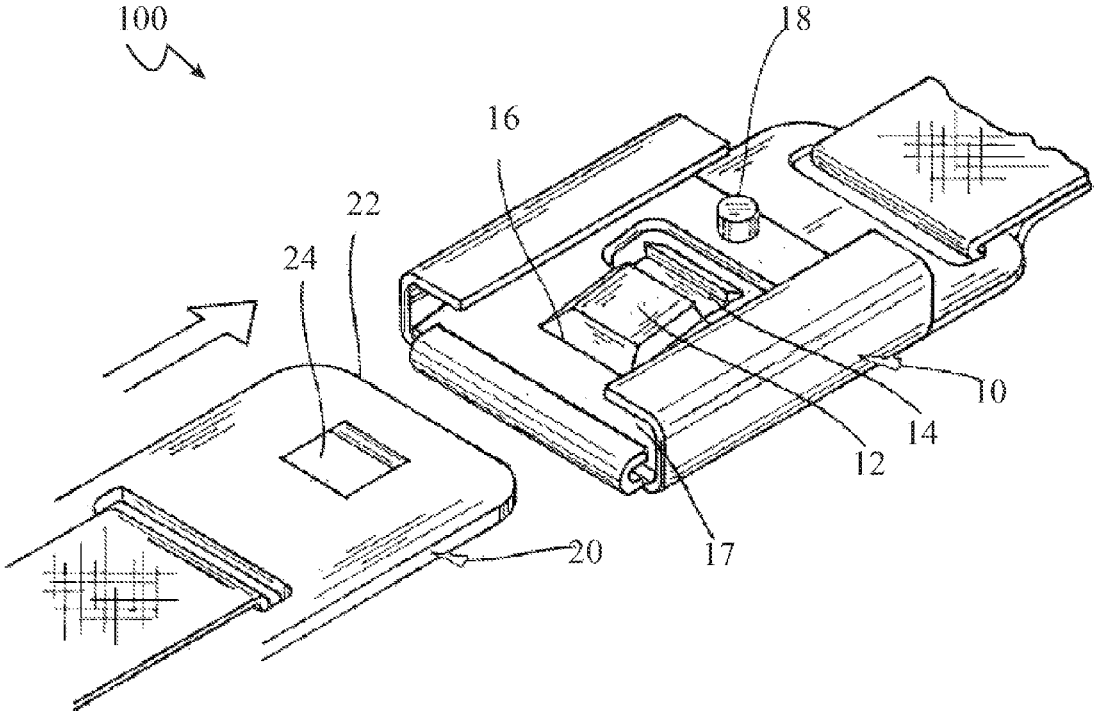
FIG. 1 illustrates an isometric view of a tongue and buckle arrangement for a seat belt in accordance with an embodiment of the present disclosure.

FIG. 1 of the accompanying drawings illustrates an isometric view of a tongue and buckle arrangement 100 for a seat belt or a seat belt buckle assembly 100 in accordance with an embodiment of the present disclosure. The tongue and buckle arrangement 100 comprises a female buckle 10 and a male tongue plate 20. More particularly, the male tongue plate 20 is affixed to one free end of the seat belt and the buckle 10 is affixed to the opposing free end of the seat belt or on the vehicle floor or seat via buckle metal stalk. The buckle 10 includes a pawl 12 mounted on a pawl assembly 17 that in turn is disposed inside the buckle 10 and is supported by a spring 14. The male tongue plate 20 is substantially planar and includes a slot 24. The male tongue plate 20 rides over an inclined end 16 of the pawl 12, depressing the pawl 12 and compressing the spring 14, when the leading end 22 of the tongue plate 20 is inserted into an open receiving end 16 of the buckle 10 and advanced there into. Continued advancement of the tongue plate 20 into the buckle 10 brings the slot 24 into alignment with the pawl 12 and the spring 14 urges the pawl 12 upwardly into the slot 24 thereby completing locking engagement between the buckle 10 and the tongue plate 20. The locking engagement is released when the spring 14 is compressed by the application of manual pressure to the seat belt release button 18.

The spring 14 is comprised of a material that converts the translational energy of the tongue and buckle arrangement 100 (due to rapid acceleration or deceleration thereof) into another form of energy when the tongue and buckle arrangement 100 experiences rapid loading. The spring can be made from any material that exhibits elastic properties.

Figure 2:
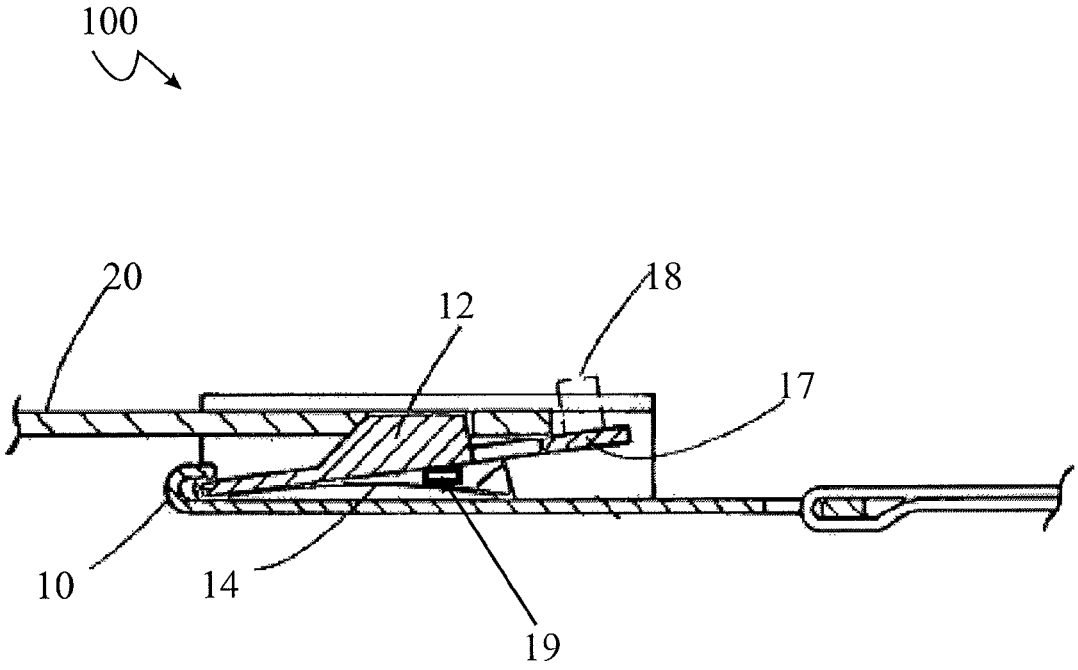
FIG. 2 illustrates a sectional view of the tongue and buckle arrangement of FIG. 1, wherein the tongue and buckle arrangement is in disengaged configuration.
Figure 3A:
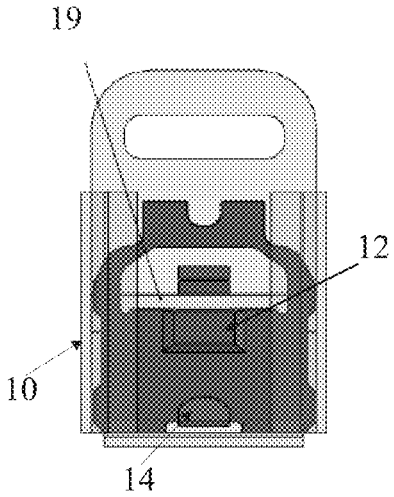
FIG. 3(*a*) illustrates a top view for the tongue and buckle arrangement of FIG. 1 provided with load rate sensitive foam member disposed between the pawl mounting member and the buckle.
Figure 3C:
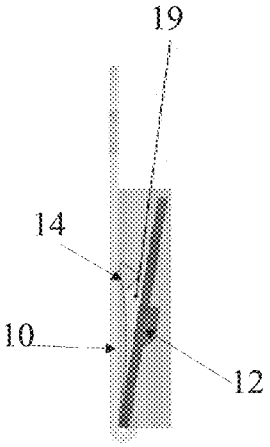
Figure 3B:
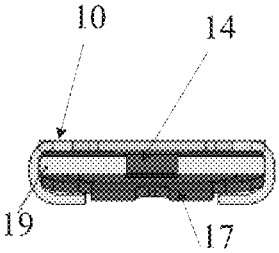
Figure 3D:
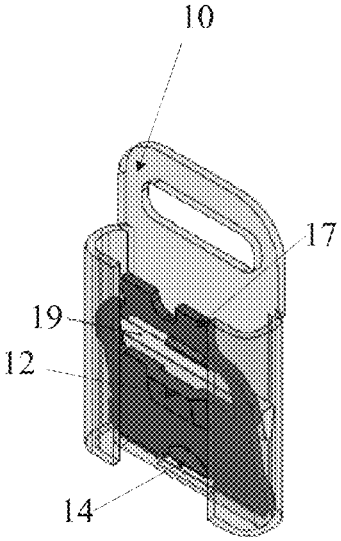

FIG. 2 of the accompanying drawings illustrate a simplified cross-sectional side view of the tongue and buckle arrangement 100 of FIG. 1, wherein the tongue plate 20 and the buckle 10 are in locking engagement, after the tongue plate 20 is inserted into the buckle 10. The tongue and buckle arrangement 100 comprising the pawl 12 and the release button 18 has a mass and inertia. When a high-G event (crash) occurs, and the momentum of the subassembly is abruptly changed, the momentum of the subassembly may compress the spring 14 and cause the pawl 12 of the pawl assembly 17 to disengage from the slot 24 in the tongue plate 20 and release. Further, a load rate sensitive foam member 19 is interposed between the pawl assembly 17 and the spring 14. More particularly, the load rate sensitive foam member 19 is highly sensitive to change in load rate. The load rate sensitive foam member 19 is preferably disposed along the spring 14 as is illustrated in FIG. 3(*a*)-FIG. 3(*d*). In case of a "high G" event such as a crash, wherein the rate of change in the load is abrupt the load rate sensitive foam member 19 absorbs most of the load and restrains any load from getting transmitted to the spring 14, thereby resisting compression of the spring 14 in response to impulsive loading i.e. when the rate of change in the load is abrupt (i.e., in the order of milliseconds). However, in case to gradual loading (i.e., in the order of a second) as is in the case of intentional pressing of the seat belt release button 18, the load rate sensitive foam member 19 readily transmits the load to the spring 14, thereby facilitating compression of the spring 14 in response to gradual loading (i.e., on the order of a second).

The load rate sensitive foam member 19 is preferably made from polyethylene scaffold. Further, the load rate sensitive foam member 19 is impregnated with carbon nano-particles that further enhance the load rate sensitivity of the load rate sensitive foam member 19. The load rate sensitive foam member 19 is made from such a material that resists compression only in response to impulsive loading when the rate of change in the load is abrupt (i.e., on the order of milliseconds), and readily compress in response to gradual loading (i.e., on the order of a second). However, the present disclosure is not limited to any particular material and process for configuring the load rate sensitive foam member 19 until it exhibits high load rate sensitivity.

The load rate sensitive foam member 19 will dissipate much of the translational energy of the tongue and buckle arrangement 100 and prevent such unintentional disengagement of the tongue plate 20 from the buckle 10.

Technical Advantages

The technical advantages of the present disclosure include in providing:

- a tongue and buckle arrangement for a seat belt, wherein the tongue and buckle arrangement resists unintentional unlatching when subjected to rapid acceleration or deceleration;
- a tongue and buckle arrangement that is unresponsive to a force impulse having a very short duration such as 1-5 milliseconds or less;
- a tongue and buckle arrangement that is responsive to a uniform force applied to overcome the force of the spring over a longer period of time such as 1 second or more;
- a tongue and buckle arrangement that is reliable and ensures safety of the wearer wearing the seat belt;
- a tongue and buckle arrangement that is easy to manufacture;
- a tongue and buckle arrangement that makes use of simpler mechanisms;
- a tongue and buckle arrangement that is having a simple structure;
- a tongue and buckle arrangement that is simple to assemble;
- a tongue and buckle arrangement is inexpensive;

While considerable emphasis has been placed herein on the particular features of this disclosure, it will be appreciated that various modifications can be made, and that many changes can be made in the preferred embodiment without departing from the principles of the disclosure. These and other modifications in the nature of the disclosure or the preferred embodiments will be apparent to those skilled in the art from the disclosure herein, whereby it is to be distinctly understood that the foregoing descriptive matter is to be interpreted merely as illustrative of the disclosure and not as a limitation.

What is claimed is:

1. A seat belt buckle assembly operable for resisting unintentional opening when subjected to rapid acceleration or deceleration, said seat belt buckle assembly comprising:

- a female buckle having a casing with an open end;
- a male tongue plate that is substantially planar and provided with a slot configured thereon, wherein a portion of said tongue plate having said slot is adapted to be received by said open end of said casing and said male tongue plate is adapted to slide inside said female buckle;
- a pawl assembly housed within said casing, said pawl assembly comprising a pawl dimensioned to fit within said slot in said tongue plate;
- a spring disposed between said casing and said pawl assembly, said spring being operable for urging said pawl of said pawl assembly into said slot, said spring being elastically deformable when subjected to force applied on said pawl; and
- a load rate sensitive foam member interposed between said spring and said pawl assembly, said load rate sensitive foam member adapted to transmit load applied on said pawl to said spring to facilitate compression of said spring and therefore unlatching of said buckle in case of gradual loading, but inhibiting involuntary compression of said spring by absorbing most of the impulsive loading acting on said pawl.

2. A seat belt buckle-assembly as claimed in claim 1, wherein said load rate sensitive foam member is made from polyethylene scaffold.

3. A seat belt buckle-assembly as claimed in claim 1, wherein said load rate sensitive foam member is impregnated with carbon nano-particles.

4. A seat belt buckle-assembly as claimed in claim 1, wherein said load rate sensitive foam member is configured to fit in the space between said spring and said pawl assembly.

5. A seat belt buckle-assembly as claimed in claim 1, wherein said spring is made from a material that exhibits elastic properties.

* * * * *